US010163389B2

(12) United States Patent
An et al.

(10) Patent No.: US 10,163,389 B2
(45) Date of Patent: Dec. 25, 2018

(54) ELECTRONIC DEVICE INCLUDING AN ORGANIC LIGHT EMITTING DIODE DISPLAY DEVICE, AND A METHOD OF COMPENSATING FOR A DEGRADATION OF AN ORGANIC LIGHT EMITTING DIODE DISPLAY DEVICE IN AN ELECTRONIC DEVICE

(71) Applicant: SAMSUNG DISPLAY CO., LTD., Yongin-si, Gyeonggi-Do (KR)

(72) Inventors: Bo-Young An, Hwaseong-si (KR); Ho-Suk Maeng, Seoul (KR); Jong-Woong Park, Seongnam-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 73 days.

(21) Appl. No.: 15/370,044

(22) Filed: Dec. 6, 2016

(65) Prior Publication Data

US 2017/0162103 A1 Jun. 8, 2017

(30) Foreign Application Priority Data

Dec. 7, 2015 (KR) ..... 10-2015-0173174

(51) Int. Cl.
*G09G 3/3208* (2016.01)

(52) U.S. Cl.
CPC ... *G09G 3/3208* (2013.01); *G09G 2320/0285* (2013.01); *G09G 2320/045* (2013.01); *G09G 2320/048* (2013.01); *G09G 2320/0626* (2013.01); *G09G 2320/0666* (2013.01)

(58) Field of Classification Search
CPC ... G09G 3/3208; G09G 3/3611; G09G 3/3233
See application file for complete search history.

(56) References Cited

U.S. PATENT DOCUMENTS

2003/0214521 A1* 11/2003 Osame ..... G09G 3/3216 345/690
2014/0111567 A1* 4/2014 Nathan ..... G09G 3/3233 345/694
2014/0168191 A1* 6/2014 Byeon ..... G09G 3/3233 345/212
2016/0335965 A1* 11/2016 Huang ..... G09G 3/3208
2017/0076659 A1* 3/2017 Zhang ..... G09G 3/3208

FOREIGN PATENT DOCUMENTS

KR 10-0759634 9/2007
KR 10-1243353 3/2013

* cited by examiner

*Primary Examiner* — Sepehr Azari
(74) *Attorney, Agent, or Firm* — F. Chau & Associates, LLC

(57) ABSTRACT

An electronic device includes an organic light emitting diode (OLED) display device, and a display controller configured to provide image data to the OLED display device. The display controller calculates stress data for the OLED display device by accumulating the image data, and determines a compensation factor for the OLED display device based on the stress data. The OLED display device receives the image data and the compensation factor from the display controller, converts the image data into compensated image data based on the compensation factor, and displays an image based on the compensated image data.

10 Claims, 11 Drawing Sheets

ELECTRONIC DEVICE INCLUDING AN ORGANIC LIGHT EMITTING DIODE DISPLAY DEVICE, AND A METHOD OF COMPENSATING FOR A DEGRADATION OF AN ORGANIC LIGHT EMITTING DIODE DISPLAY DEVICE IN AN ELECTRONIC DEVICE

CROSS-REFERENCE TO RELATED APPLICATION(S)

This application claims priority under 35 U.S.C. § 119 to Korean Patent Application No. 10-2015-0173174, filed on Dec. 7, 2015, in the Korean Intellectual Property Office (KIPO), the disclosure of which is incorporated by reference herein in its entirety.

TECHNICAL FIELD

Exemplary embodiments of the present invention relate to display devices and electronic devices including the display devices. More particularly, exemplary embodiments of the present invention relate to electronic devices including organic light emitting diode (OLED) display devices, and methods of compensating for a degradation of the OLED display devices in the electronic devices.

DISCUSSION OF THE RELATED ART

In an organic light emitting diode (OLED) display device, as a driving time of each pixel increases, the OLED included in each pixel tends to degrade. The degradation of a pixel may cause the luminance of a pixel to decrease. The degradation of the pixels may be compensated such that the pixel luminance level is maintained at a predetermined level. However, a powerful processor and a large amount of memory may be needed to perform the compensation process.

SUMMARY

An exemplary embodiment of the present invention relates to an electronic device that may perform a pixel degradation compensation process efficiently.

An exemplary embodiment of the present invention relates to a method of compensating for a degradation of an organic light emitting diode (OLED) display device included in an electronic device.

According to an exemplary embodiment of the present invention, an electronic device includes an OLED display device, and a display controller configured to provide image data to the OLED display device. The display controller calculates stress data for the OLED display device by accumulating the image data, and determines a compensation factor for the OLED display device based on the stress data. The OLED display device receives the image data and the compensation factor from the display controller, converts the image data into compensated image data based on the compensation factor, and displays an image based on the compensated image data.

According to an exemplary embodiment of the present invention, an electronic device includes an OLED display device, and a display controller configured to provide image data to the OLED display device. The display controller calculates stress data for the OLED display device by accumulating the image data, and stores the stress data. The OLED display device receives the image data and the stress data from the display controller, determines a compensation factor in response to the stress data, converts the image data into compensated image data in response to the compensation factor, and displays an image in response to the compensated image data.

According to an exemplary embodiment of the present invention, in a method of compensating for degradation in an electronic device, the electronic device including an OLED display device, and a display controller configured to provide image data to the OLED display device, the OLED display device including a red sub-pixel, a green sub-pixel and a blue sub-pixel, the display controller calculates stress data for the OLED display device by accumulating the image data, the stress data are stored in the display controller, the display controller calculates a common compensation factor for red, the green and the blue sub-pixels, and calculates an additional compensation factor for the red sub-pixel, an additional compensation factor for the green sub-pixel and an additional compensation factor for the blue sub-pixel, the display controller performs a first compensation operation on the image data in response to the common compensation factor, the display controller transfers the image data on which the first compensation operation is performed and the red, green and blue additional compensation factors to the OLED display device, the OLED display device performs a second compensation operation on the image data on which the first compensation operation is performed in response to the red, green and blue additional compensation factors to generate compensated image data, and the OLED display device displays an image in response to the compensated image data.

BRIEF DESCRIPTION OF THE DRAWINGS

The above and other aspects of the present invention will become more apparent by describing in detail exemplary embodiments thereof in conjunction with the accompanying drawings, in which.

DETAILED DESCRIPTION OF THE EMBODIMENTS

Figure 1:
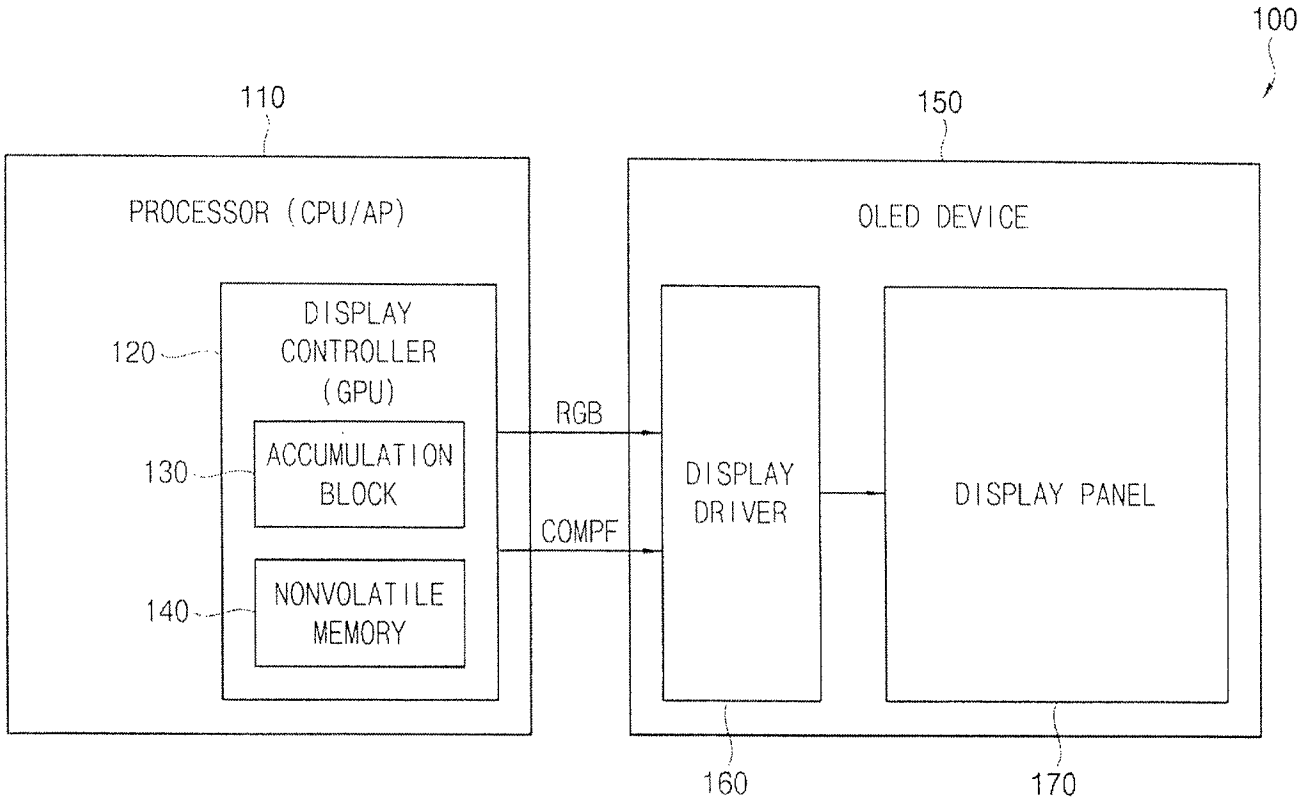
FIG. 1 is a block diagram illustrating an electronic device according to an exemplary embodiment of the present invention.

Exemplary embodiments of the present invention will now be described more fully hereinafter with reference to the accompanying drawings. Like reference numerals may refer to like elements throughout the specification. It is to be understood that the "blocks" referred to throughout the specification, for example, the accumulation block 130, the first compensation block 250, the common factor calculating block 240, the compensation factor calculating block 230, the accumulation block 210, the data input block 270, the second compensation block 290, the additional factor input block 280, etc., may include hardware components such as circuits.

Figure 2:
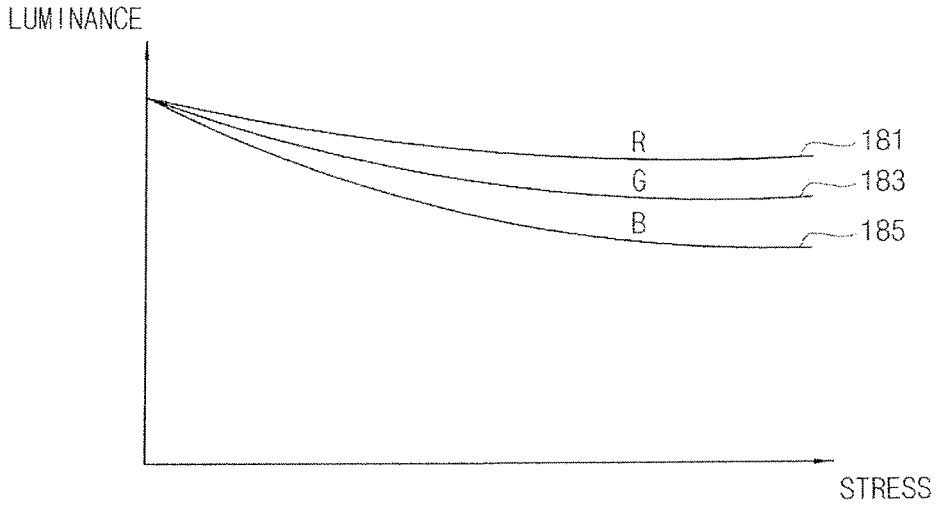
FIG. 2 is a graph illustrating a luminance of red, green and blue sub-pixels as a function of stress, according to an exemplary embodiment of the present invention.
Figure 3:
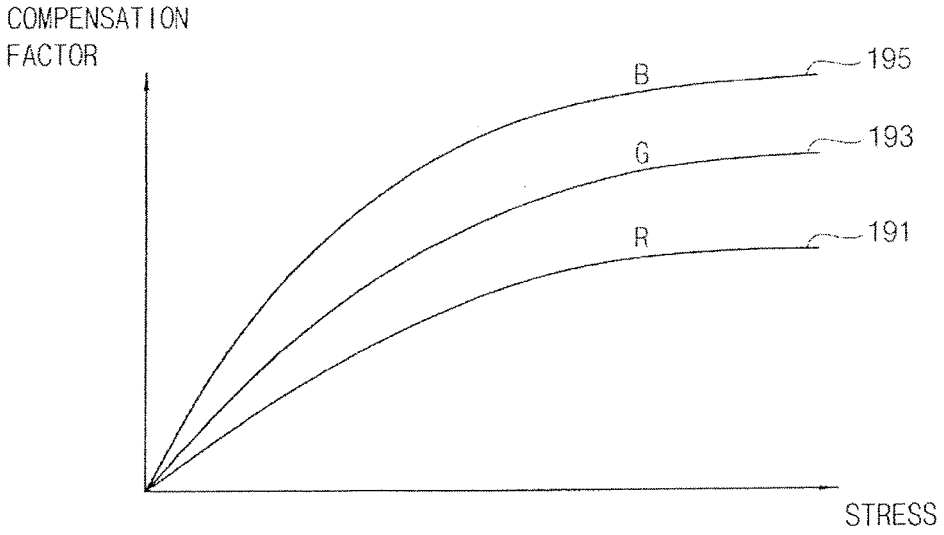
FIG. 3 is a graph illustrating compensation factors for red, green and blue sub-pixels as a function of stress, according to an exemplary embodiment of the present invention.
Figure 4:
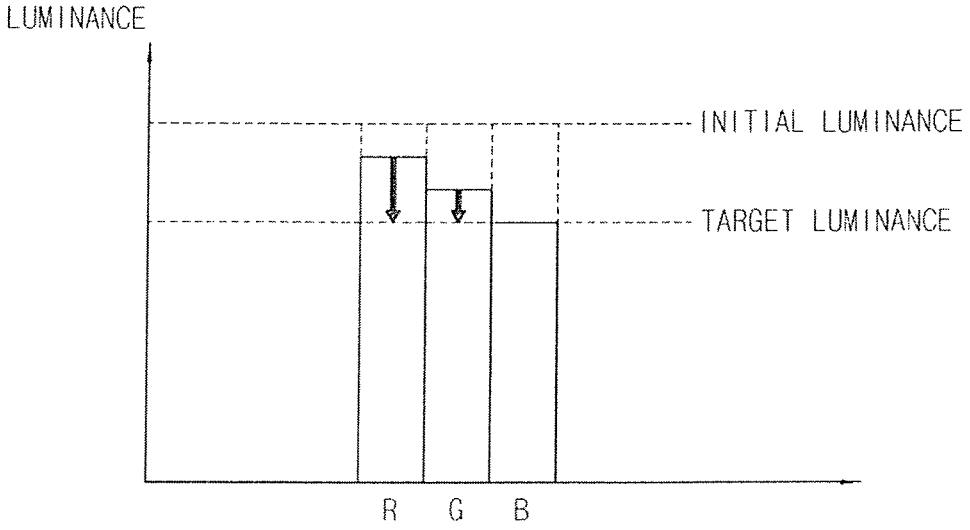
FIG. 4 is a graph illustrating a compensation operation that compensates for a degradation of red, green and blue sub-pixels, according to an exemplary embodiment of the present invention.

FIG. 1 is a block diagram illustrating an electronic device according to an exemplary embodiment of the present invention. FIG. 2 is a graph illustrating a luminance of red, green and blue sub-pixels as a function of stress, according to an exemplary embodiment of the present invention. FIG. 3 is a graph illustrating compensation factors for red, green and blue sub-pixels as a function of stress, according to an exemplary embodiment of the present invention. FIG. 4 is a graph illustrating a compensation operation that compensates for a degradation of red, green and blue sub-pixels, according to an exemplary embodiment of the present invention.

Referring to FIG. 1, an electronic device 100 includes a processor 110 that controls an overall operation of the electronic device 100, and an organic light emitting diode (OLED) display device 150 that displays an image. According to an exemplary embodiment of the present invention, the electronic device 100 may be any electronic device that includes the OLED display device 150. The electronic device 100 may be, for example, a cellular phone, a smart phone, a tablet computer, a wearable device, a personal digital assistant (PDA), a portable multimedia player (PMP), a digital camera, a music player, a portable game console, a navigation system, a digital television, a three-dimensional (3D) television, a personal computer (PC), a home appliance, a laptop computer, etc.

The processor 110 may perform various computing functions, and may control the electronic device 100. In an exemplary embodiment of the present invention, the electronic device 100 may be a mobile device, for example, a smart phone, a tablet computer, or the like, and the processor 110 may be an application processor (AP). In an exemplary embodiment of the present invention, the processor 110 may be a central processing unit (CPU), a micro processor, etc. The processor 110 may include a display controller 120 that controls the OLED display device 150.

The display controller 120 may provide red, green and blue (RGB) image data (e.g., image data RGB) to the OLED display device 150 by performing predetermined graphics and image processing. In an exemplary embodiment of the present invention, the display controller 120 may be a graphics processing unit (GPU) included in the processor 110 that controls an operation of the electronic device 100. In an exemplary embodiment of the present invention, the display controller 120 may be a graphics card.

The display controller 120 may include an accumulation block 130 that calculates the stress data for the OLED display device 150 by accumulating the image data RGB provided to the OLED display device 150. In addition, the display controller 120 may include and a nonvolatile memory 140 that stores the stress data. For example, the accumulation block 130 may add current stress data corresponding to current image data RGB to the stress data stored in the nonvolatile memory 140. In other words, the accumulation block 130 may rewrite the stress data already stored in the nonvolatile memory 140 with the current stress data in the nonvolatile memory 140. In an exemplary embodiment of the present invention, the accumulation block 130 may calculate the stress data not only based on the image data RGB, but also based on a luminance information, a loading information, a temperature information, information about a stress level for each gray level, etc. The nonvolatile memory 140 may store the stress data calculated by the accumulation block 130. The nonvolatile memory 140 may retain the stored stress data when the electronic device 100 is powered off. In an exemplary embodiment of the present invention, the nonvolatile memory 140 may be a flash memory included in the processor 110. According to an exemplary embodiment of the present invention, the nonvolatile memory 140 may be located inside or outside the display controller 120. Thus, in the electronic device 100, according to an exemplary embodiment of the present invention, the calculation and the storage of the stress data for the degradation compensation of the OLED display device 150 may be performed by the display controller 120 instead of the OLED display device 150.

In an exemplary embodiment of the present invention, the display controller 120 may determine a compensation factor COMPF for the degradation compensation of the OLED display device 150 based on the stress data stored in the nonvolatile memory 140. In the OLED display device 150, as an accumulated driving time or an accumulated driving amount of each pixel increases, or as an accumulated stress applied to each pixel increases, an OLED included in each pixel may be degraded. When the OLED included in a pixel is degraded, a luminance of the pixel may be decreased. In an exemplary embodiment of the present invention, each pixel of the OLED display device may include a red sub-pixel R, a green sub-pixel G and a blue sub-pixel B. The red, green and blue sub-pixels R, G and B may have different degradation degrees at the same accumulated stress. For example, as illustrated in FIG. 2, the luminance of the red, green and blue sub-pixels R, G and B may decrease as an accumulated stress applied to the red, green and blue sub-pixels R, G and B increases. In addition, decrements of the luminance of the red, green and blue sub-pixels R, G and B may be different from each other at the same accumulated stress. In the example illustrated in FIG. 2, at the same accumulated stress, the blue sub-pixel B may have the largest luminance decrement, or the highest degradation degree, and the red sub-pixel R may have the smallest luminance decrement, or the lowest degradation degree. However, the luminance versus stress relationship of FIG. 2 is merely exemplary, and the degradation degrees of the red, green and blue sub-pixels R, G and B, as a function of the accumulated stress, may be changed depending on the luminescent materials, etc, included in the red, green and blue sub-pixels R, G and B. The display controller 120 may determine the compensation factor COMPF to compensate for the luminance decrease based on the accumulated stress. For example, as illustrated in FIG. 3, the display controller 120 may determine compensation factors 191, 193 and 195 for the red, green and blue sub-pixels R, G and B, respectively, to be increased as the accumulated stress, indicated by the stress data stored in the nonvolatile memory 140, increases. In the example illustrated in FIG. 3, when the red, green and blue sub-pixels R, G and B have the same accumulated stress, the blue sub-pixel B may have the highest compensation factor 195, and the red sub-pixel R may have the lowest compensation factor 191. However, the present invention is not limited thereto.

The OLED display device 150 may receive the image data RGB from the display controller 120, and may display an image based on the image data RGB. The OLED display device 150 may include a display panel 170, and a display driver 160 for driving the display panel 170.

The display panel 170 may include a plurality of pixels that are arranged in a matrix having a plurality of rows and a plurality of columns. In an exemplary embodiment of the present invention, each pixel may include a red sub-pixel R that emits red light, a green sub-pixel G that emits green light, and a blue sub-pixel B that emits blue light. The display panel 170 may be an OLED display panel where each sub-pixel includes an OLED.

The display driver 160 may drive the display panel 170 to display an image corresponding to the image data RGB provided by the display controller 120. In an exemplary embodiment of the present invention, the display driver 160 may include a scan driver that selects each row of the display panel 170, a source driver that applies a data signal to sub-pixels in the selected row, and a timing controller that controls the scan driver and the source driver.

The display driver 160 of the OLED display device 150 may further receive the compensation factor COMPF from the display controller 120, may convert the image data RGB into compensated image data based on the compensation factor COMPF, and may drive the display panel 170 to display an image based on the compensated image data. In a case where the red, green and blue R, G and B sub-pixels have different luminance decrements or different degradation degrees, a color characteristic, such as a color coordinate, of each pixel may be distorted. However, in the electronic device 100, according to an exemplary embodiment of the present invention, since the pixels are driven based on the compensated image data, the color characteristics of the pixels may not be distorted.

In an exemplary embodiment of the present invention, the compensation factor COMPF may be determined such that the red, green and blue sub-pixels R, G and B have substantially the same luminance based on the luminance of one of the red, green and blue sub-pixels R, G and B having the largest luminance decrement, or the highest degradation degree, and the image data RGB may be converted into the compensated image data based on the determined compensation factor COMPF. For example, as illustrated in FIG. 4, when the luminance decrement of the blue sub-pixel B from an initial luminance is greater than those of the red and green sub-pixels R and G, the image data for the red and green sub-pixels R and G may be decreased such that the red and green sub-pixels R and G have substantially the same luminance as the blue sub-pixel B. Accordingly, the red, green and blue sub-pixels R, G and B may have uniform luminance, and thus color characteristics of the pixels may not be distorted or the distortion may be small.

In an exemplary embodiment of the present invention, the compensation factor COMPF may be determined such that a target luminance of the red, green and blue sub-pixels R, G and B is substantially the same based on the luminance of one of the red, green and blue sub-pixels R, G and B having the smallest luminance decrement, or the lowest degradation degree. In this case, the image data RGB may be converted into the compensated image data based on the determined compensation factor COMPF. In other words, based on the luminance of one of the red, green and blue sub-pixels R, G and B having the lowest degradation degree, the image data for the others of the red, green and blue sub-pixels R, G and B may be increased. In an exemplary embodiment of the present invention, the compensation factor COMPF may be determined such that the red, green and blue sub-pixels R, G and B have a predetermined target luminance, and the image data RGB may be converted into the compensated image data based on the determined compensation factor COMPF.

In an exemplary embodiment of the present invention, the display controller 120 may determine a compensation factor COMPF per each individual sub-pixel, and the display driver 160 may apply a different compensation factor COMPF to each of the sub-pixels of the display panel 170. In an exemplary embodiment of the present invention, the display controller 120 may determine a compensation factor COMPF per a sub-pixel block, the sub-pixel block including a plurality of adjacent sub-pixels (e.g., 10 sub-pixels*10 sub-pixels), and the display driver 160 may apply the same compensation factor COMPF to all of the sub-pixels included in the sub-pixel block. This operation may be performed for each sub-pixel block of the display panel 170. Further, in an exemplary embodiment of the present invention, the display controller 120 may transfer the compensation factor COMPF to the OLED display device 150 only when the OLED display device 150 is powered on. In an exemplary embodiment of the present invention, the display controller 120 may transfer the compensation factor COMPF to the OLED display device 150 when a mode of the OLED display device 150 is changed from a standby mode to a normal operation mode. In an exemplary embodiment of the present invention, the display controller 120 may periodically transfer the compensation factor COMPF to the OLED display device 150. For example, the display controller 120 may transfer the compensation factor COMPF to the OLED display device 150 with a period of about one second, at a frequency substantially the same as an image frame frequency, etc.

In the electronic device 100, according to an exemplary embodiment of the present invention, the display controller 120, having a high operational throughput and a large storage space, may perform the calculation and the storage of the stress data for the degradation compensation of the OLED display device 150. Accordingly, the display driver 160 of the OLED display device 150 may have a small size, and the degradation compensation of the OLED display device 150 may be efficiently performed.

Figure 5:
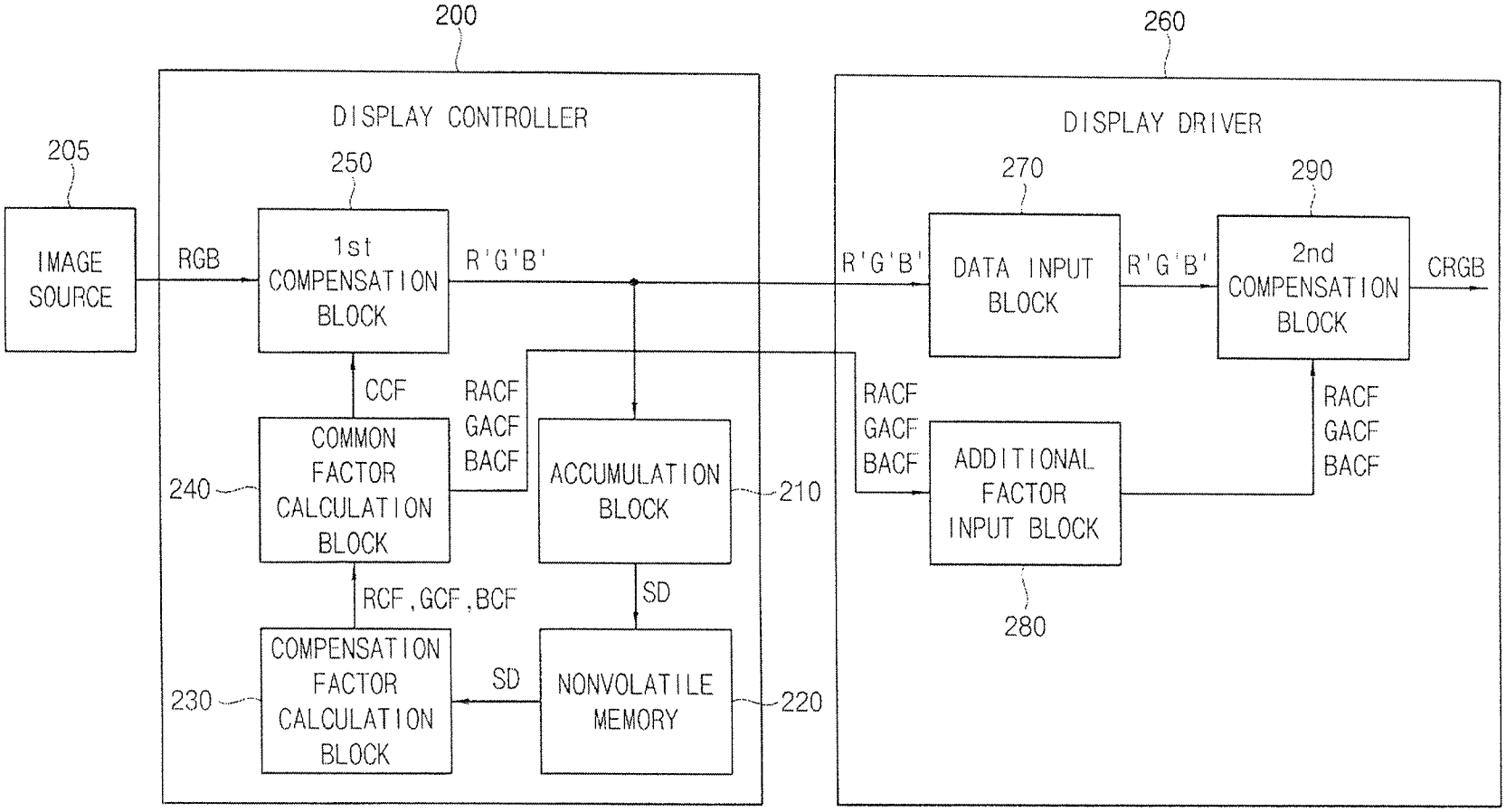
FIG. 5 is a block diagram illustrating a display controller and a display driver included in an electronic device according to an exemplary embodiment of the present invention.
Figure 6:
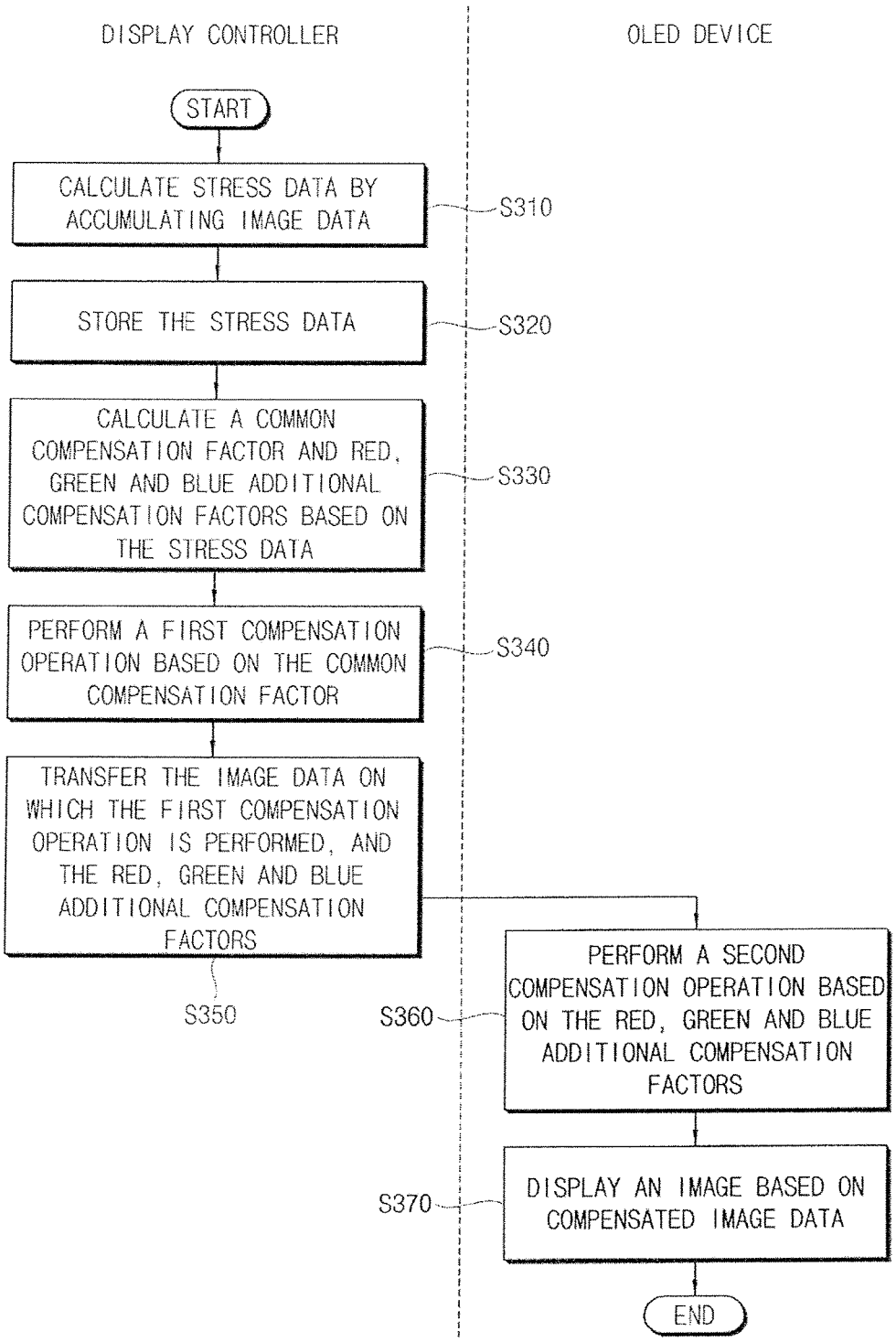
FIG. 6 is a flowchart illustrating a method of compensating for a degradation in an electronic device according to an exemplary embodiment of the present invention.
Figure 7:
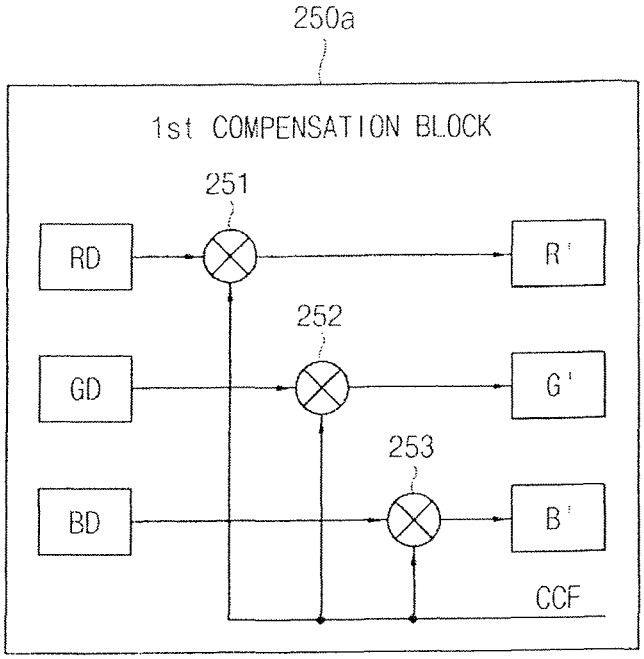
FIG. 7 is a block diagram illustrating a first compensation block included in a display controller of an electronic device according to an exemplary embodiment of the present invention.
Figure 8:
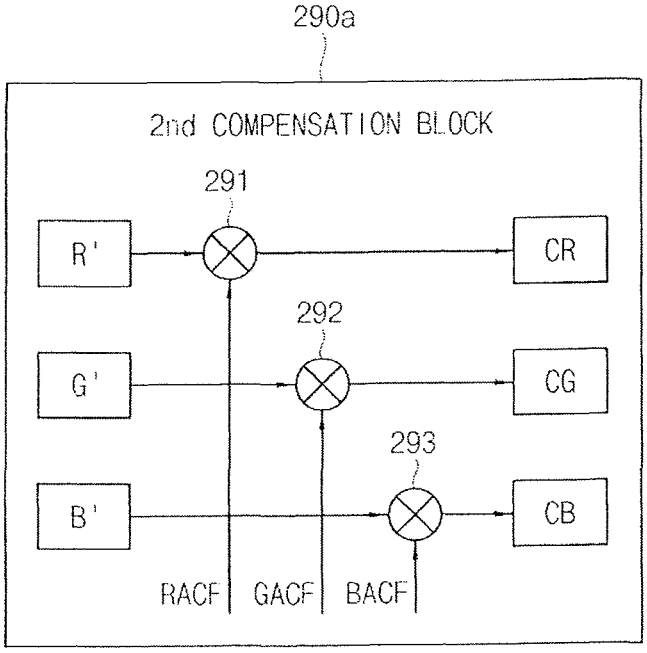
FIG. 8 is a block diagram illustrating a second compensation block included in a display driver of an electronic device according to an exemplary embodiment of the present invention.

FIG. 5 is a block diagram illustrating a display controller and a display driver included in an electronic device according to an exemplary embodiment of the present invention. FIG. 6 is a flowchart illustrating a method of compensating for a degradation in an electronic device according to an exemplary embodiment of the present invention. FIG. 7 is a block diagram illustrating a first compensation block included in a display controller of an electronic device according to an exemplary embodiment of the present invention. FIG. 8 is a block diagram illustrating a second compensation block included in a display driver of an electronic device according to an exemplary embodiment of the present invention.

Referring to FIG. 5, a display controller 200 that controls an OLED display device may include an accumulation block 210, a nonvolatile memory 220, a compensation factor calculation block 230, a common factor calculation block 240 and a first compensation block 250. A display driver 260 included in the OLED display device may include a data input block 270, an additional factor input block 280 and a second compensation block 290.

The display controller 200 may receive image data RGB from an image source 205. The accumulation block 210 may calculate stress data SD for the OLED display device by accumulating the received image data RGB or the image data R'G'B', on which a first compensation operation is performed. The stress data SD calculated by the accumulation block 210 may be stored in the nonvolatile memory 220.

The display controller 200 may determine a compensation factor based on the stress data SD stored in the nonvolatile memory 220. In an exemplary embodiment of the present invention, each pixel of the OLED display device may include a red sub-pixel R, a green sub-pixel G and a blue sub-pixel B. The display controller 200 may determine, as the compensation factor, a common compensation factor CCF for the red, green and blue sub-pixels R, G and B, a red additional compensation factor RACF for the red sub-pixel R, a green additional compensation factor GACF for the green sub-pixel G, and a blue additional compensation factor BACF for the blue sub-pixel B based on the stress data. To perform this operation, the compensation factor calculation block 230 may calculate a red compensation factor RCF for the red sub-pixel R, a green compensation factor GCF for the green sub-pixel G and a blue compensation factor BCF for the blue sub-pixel B based on the stress data SD. The common factor calculation block 240 may calculate the common compensation factor CCF, the red additional compensation factor RACF, the green additional compensation factor GACF and the blue additional compensation factor BACF based on the red compensation factor RCF, the green compensation factor GCF and the blue compensation factor BCF. In an exemplary embodiment of the present invention, the common factor calculation block 240 may determine the common compensation factor CCF to be the lowest one of the red compensation factor RCF, the green compensation factor GCF and the blue compensation factor BCF. The common factor calculation block 240 may determine the red additional compensation factor RACF to be a ratio of the red compensation factor RCF to the common compensation factor CCF. The common factor calculation block 240 may determine the green additional compensation factor GACF to be ratio of the green compensation factor GCF to the common compensation factor CCF. In addition, the common factor calculation block 240 may determine the blue additional compensation factor BACF to be a ratio of the blue compensation factor BCF to the common compensation factor CCF.

The first compensation block 250 may perform a first compensation operation on the image data RGB based on the common compensation factor CCF. Since the first compensation operation is performed based on the common compensation factor CCF, the image data RGB for the red, green and blue sub-pixels R, G and B may be compensated with the same ratio. In an exemplary embodiment of the present invention, the common compensation factor CCF may be determined (e.g., selected) to be the lowest compensation factor among the red, green and blue compensation factors RCF, GCF and BCF. Thus, the first compensation operation may be performed for the red, green and blue sub-pixels R, G and B based on a degradation degree of one of the red, green and blue sub-pixels R, G and B that is the lowest among the degradation degrees of the red, green and blue sub-pixels R, G and B.

The display driver 260 may receive the image data R'G'B', on which the first compensation operation is performed, and the red, green and blue additional compensation factors RACF, GACF and BACF from the display controller 200. The data input block 270 of the display driver 260 may receive the image data R'G'B' on which the first compensation operation is performed from the display controller 200, and the additional factor input block 280 of the display driver 260 may receive the red, green and blue additional compensation factors RACF, GACF and BACF from the display controller 200. In an exemplary embodiment of the present invention, the data input block 270 may receive data of 8 bits per each sub-pixel, and may convert the data of 8 bits into data of 10 bits. Further, in an exemplary embodiment of the present invention, the data input block 270 may apply a predetermined gamma value (e.g., about 2.2) to the image data R'G'B', representing a gray level for each sub-pixel, to generate data representing luminance of the sub-pixel.

The second compensation block 290 of the display driver 260 may perform a second compensation operation on the image data R'G'B', on which the first compensation operation is performed, based on the red, green and blue additional compensation factors RACF, GACF and BACF to generate compensated image data CRGB. In other words, the first compensation operation may be performed by the display controller 200 commonly for the red, green and blue sub-pixels R, G and B based on the common compensation factor CCF, and the second compensation operation may be performed by the display driver 260 for the red, green and blue sub-pixels R, G and B based on the red, green and blue additional compensation factors RACF, GACF and BACF, respectively. In an exemplary embodiment of the present invention, in a case where the first compensation operation is performed based on a degradation degree of one of the red, green and blue sub-pixels R, G and B that is the lowest among the degradation degrees of the red, green and blue sub-pixels R, G and B, the second compensation operation may be performed to compensate for the degradation of the other sub-pixels R, G and/or B, for example, the sub-pixels R, G and/or B that have a degradation degree other than the lowest degradation degree. The display driver 260 may drive a display panel to display an image based on the compensated image data CRGB.

Hereinafter, a method of compensating for degradation in an electronic device will be described below with reference to FIGS. 5 through 8.

Referring to FIGS. 5 and 6, the accumulation block 210 of the display controller 200 may calculate the stress data SD for the OLED display device by accumulating the image data RGB (or the image data R'G'B' on which the first compensation operation is performed) (S310). The nonvolatile memory 220 of the display controller 200 may store the stress data SD calculated by the accumulation block 210 (S320).

The compensation factor calculation block 230 of the display controller 200 may calculate the red, green and blue compensation factors RCF, GCF and BCF for the red, green and blue sub-pixels R, G and B based on the stress data SD. The common factor calculation block 240 of the display controller 200 may calculate, based on the red, green and blue compensation factors RCF, GCF and BCF, the common compensation factor CCF that is common for the red, green and blue sub-pixels R, G and B, and the red, green and blue additional compensation factors RACF, GACF and BACF, respectively, for the red, green and blue sub-pixels R, G and B (S330).

The first compensation block 250 of the display controller 200 may perform the first compensation operation on the image data RGB based on the common compensation factor CCF (S340). In an exemplary embodiment of the present invention, as illustrated in FIG. 7, the first compensation block 250*a* may include a first multiplier 251 that applies the common compensation factor CCF to red data RD of the image data RGB to generate the red data R' on which the first compensation operation is performed, a second multiplier 252 that applies the common compensation factor CCF to green data GD of the image data RGB to generate the green data G' on which the first compensation operation is performed, and a third multiplier 253 that applies the common compensation factor CCF to blue data BD of the image data RGB to generate the blue data B' on which the first compensation operation is performed. As described above, the first compensation operation may be performed by applying the common compensation factor CCF commonly to the red, green and blue data RD, GD and BD.

The display controller 200 may transfer the image data R'G'B', on which the first compensation operation is performed, and the red, green and blue additional compensation factors RACF, GACF and BACF to the display driver 260 of the OLED display device (S350).

The data input block 270 of the display driver 260 may receive the image data R'G'B', on which the first compensation operation is performed, from the display controller 200. The additional factor input block 280 of the display driver 260 may receive the red, green and blue additional compensation factors RACF, GACF and BACF from the display controller 200. The second compensation block 290 of the display driver 260 may perform the second compensation operation on the image data R'G'B', on which the first compensation operation is performed, based on the red, green and blue additional compensation factors RACF, GACF and BACF to generate the compensated image data CRGB (S360). In an exemplary embodiment of the present invention, as illustrated in FIG. 8, the second compensation block 290*a* may include a fourth multiplier 291 that applies the red additional compensation factor RACF to the red data R' on, which the first compensation operation is performed, to generate compensated red data CR, a fifth multiplier 292 that applies the green additional compensation factor GACF to the green data G', on which the first compensation operation is performed, to generate compensated green data CG, and a sixth multiplier 293 that applies the blue additional compensation factor BACF to the blue data B', on which the first compensation operation is performed, to generate compensated blue data CB. As described above, the second compensation operation may performed by applying the red, green and blue additional compensation factors RACF, GACF and BACF to the red, green and blue data R', G' and B', respectively.

The display driver 260 may drive the display panel to display an image based on the compensated image data CRGB (S370).

Thus, in a method of compensating for a degradation in an electronic device, according to an exemplary embodiment of the present invention, the display controller 200, having a high operational throughput and a large storage space, may perform the calculation and the storage of the stress data SD for the degradation compensation of the OLED display device. In addition, the display controller 200 may perform the first compensation operation on the image data RGB based on the common compensation factor CCF. Accordingly, the display driver 260 of the OLED display device may have a small size, and the degradation compensation of the OLED display device may be efficiently performed.

Figure 9:
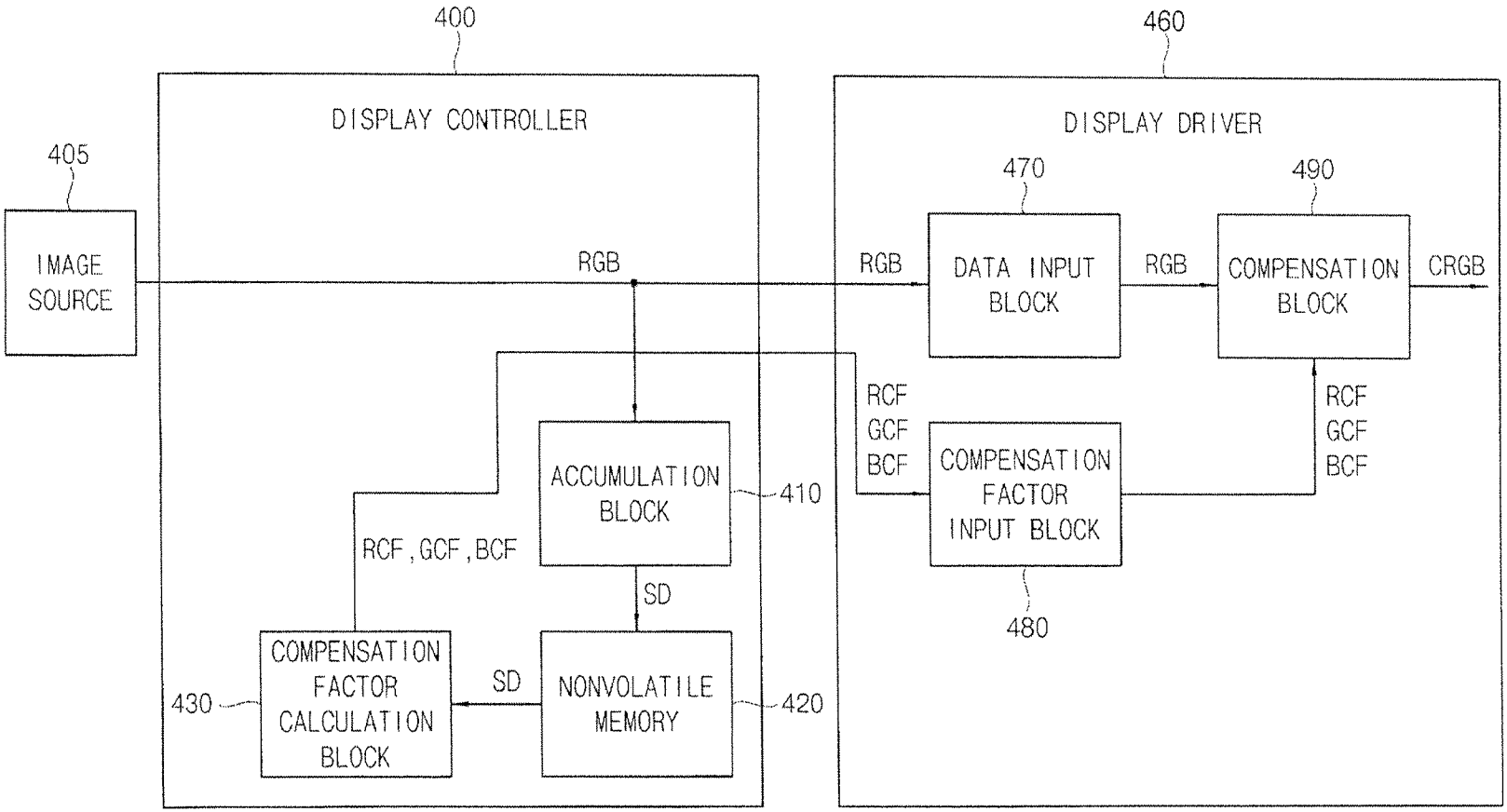
FIG. 9 is a block diagram illustrating a display controller and a display driver included in an electronic device according to an exemplary embodiment of the present invention.
Figure 10:
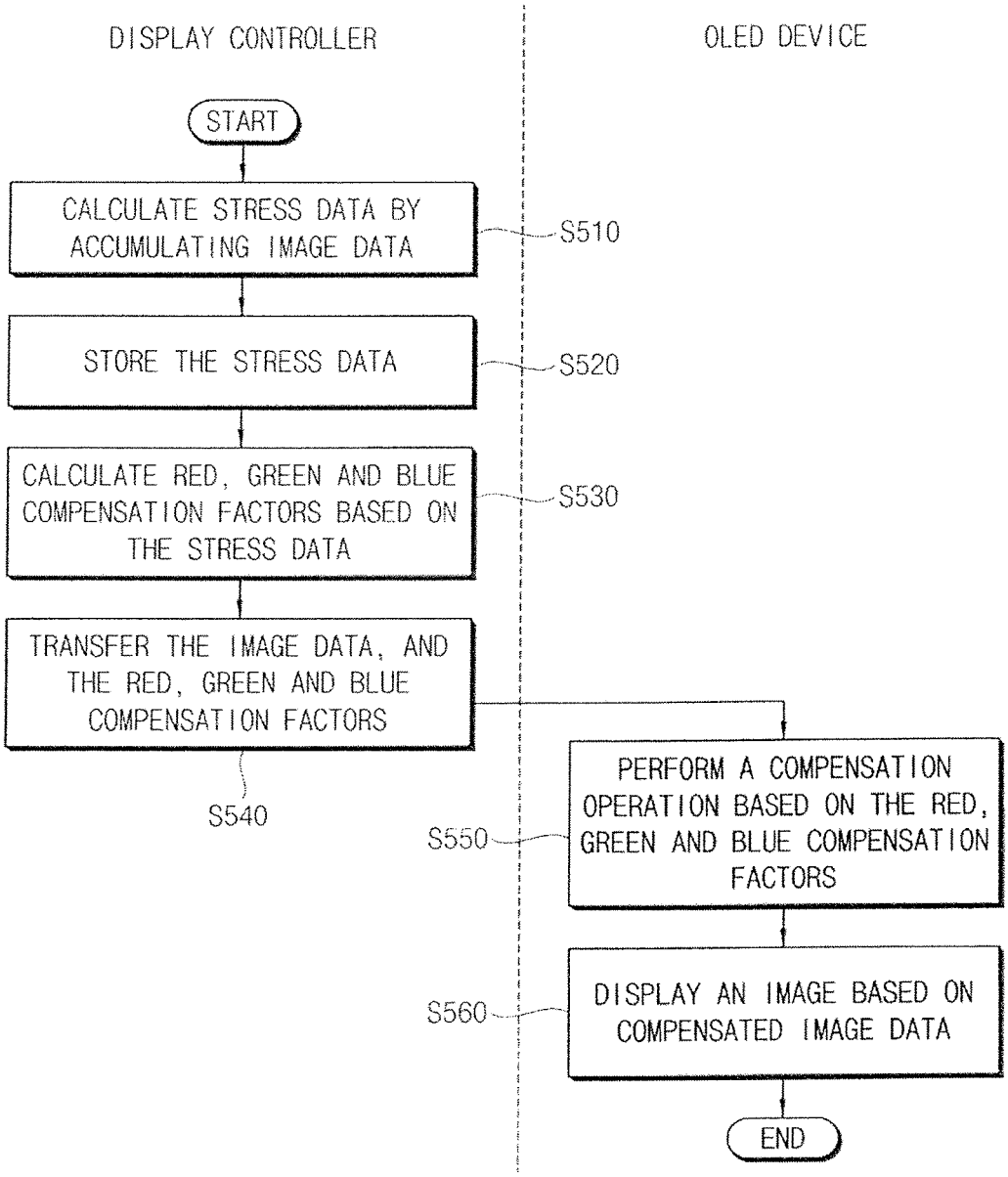
FIG. 10 is a flowchart illustrating a method of compensating for a degradation in an electronic device according to an exemplary embodiment of the present invention.

FIG. 9 is a block diagram illustrating a display controller and a display driver included in an electronic device according to an exemplary embodiment of the present invention. FIG. 10 is a flowchart illustrating a method of compensating for a degradation in an electronic device according to an exemplary embodiment of the present invention.

Referring to FIG. 9, a display controller 400 that controls an OLED display device may include an accumulation block 410, a nonvolatile memory 420 and a compensation factor calculation block 430. A display driver 460 included in the OLED display device may include a data input block 470, a compensation factor input block 480 and a compensation block 490. The display controller 400 of FIG. 9 may not perform a first compensation operation, and may provide, as a compensation factor, red, green and blue compensation factors RCF, GCF and BCF to the display driver 460.

Referring to FIGS. 9 and 10, the display controller 400 may receive image data RGB from an image source 405. The accumulation block 410 of the display controller 400 may calculate stress data SD for the OLED display device by accumulating the image data RGB (S510). The nonvolatile memory 420 of the display controller 400 may store the stress data SD calculated by the accumulation block 410 (S520).

The compensation factor calculation block 430 of the display controller 400 may calculate the red, green and blue compensation factors RCF, GCF and BCF for red, green and blue sub-pixels R, G and B based on the stress data SD (S530). The display controller 400 may transfer the image data RGB and the red, green and blue compensation factors RCF, GCF and BCF to the display driver 460 of the OLED display device (S540).

The data input block 470 of the display driver 460 may receive the image data RGB from the display controller 400. The compensation factor input block 480 of the display driver 460 may receive the red, green and blue compensation factors RCF, GCF and BCF from the display controller 400, and the compensation block 490 of the display driver 460 may perform a compensation operation on the image data RGB based on the red, green and blue compensation factors RCF, GCF and BCF to generate compensated image data CRGB (S550). The display driver 460 may drive a display panel to display an image based on the compensated image data CRGB (S560).

Thus, in a method of compensating for a degradation in an electronic device, according to an exemplary embodiment of the present invention, the display controller 400, having a high operational throughput and a large storage space, may perform the calculation and the storage of the stress data SD for degradation compensation of the OLED display device. In addition, the display controller 400 may determine the red, green and blue compensation factors RCF, GCF and BCF for the red, green and blue sub-pixels R, G and B. Accordingly, the display driver 460 of the OLED display device may have a small size, and the degradation compensation of the OLED display device may be efficiently performed.

Figure 11:
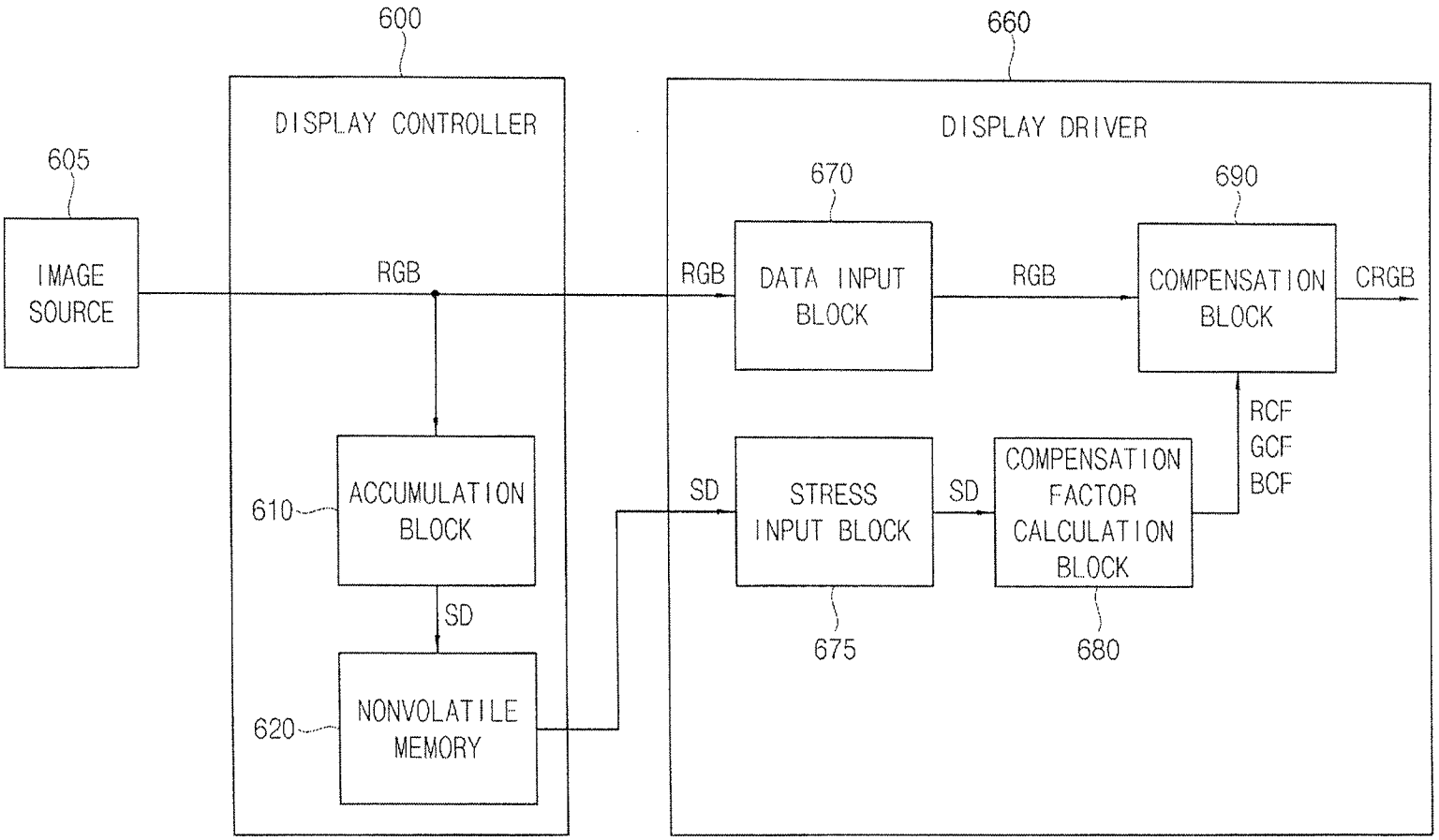
FIG. 11 is a block diagram illustrating a display controller and a display driver included in an electronic device according to an exemplary embodiment of the present invention.
Figure 12:
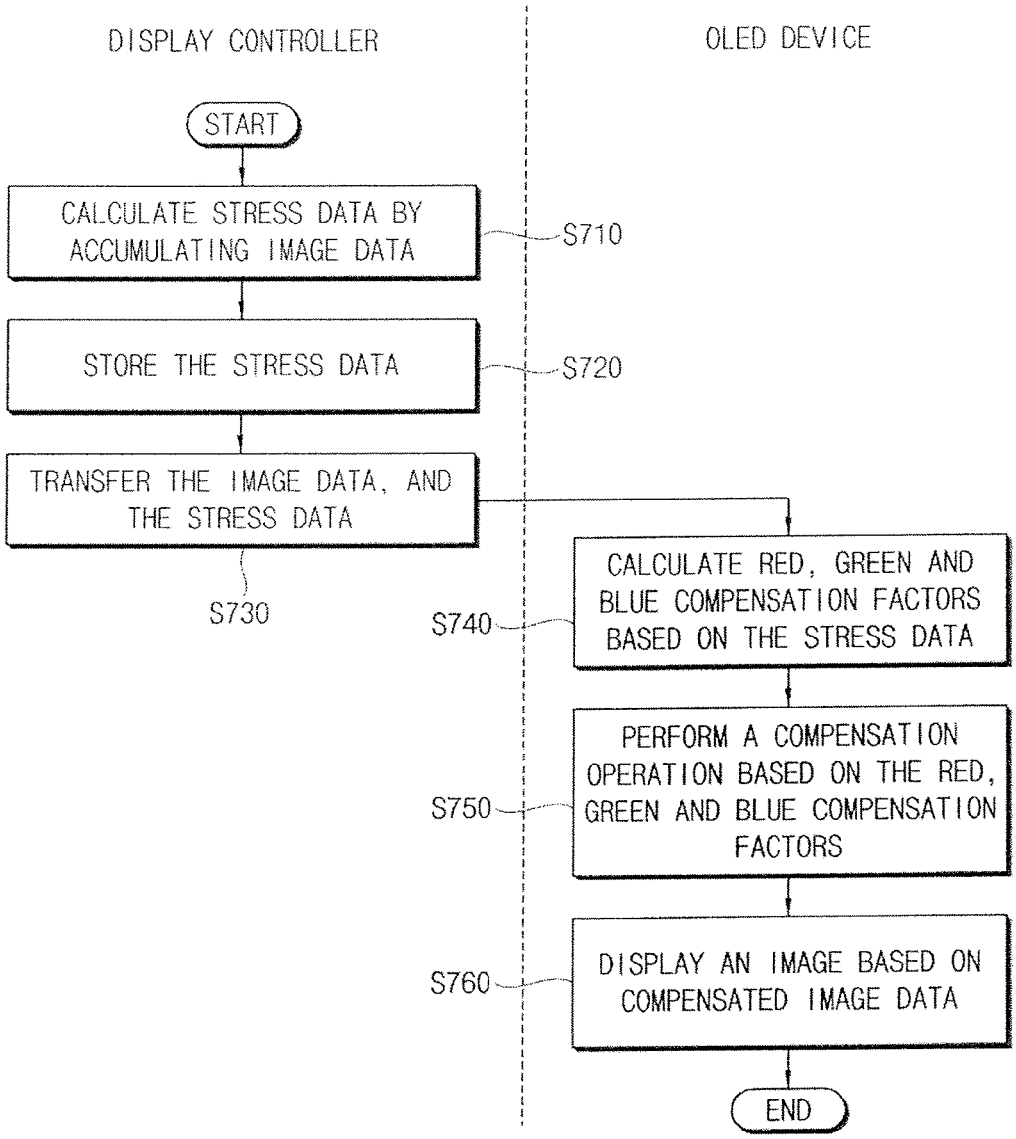
FIG. 12 is a flowchart illustrating a method of compensating for a degradation in an electronic device according to an exemplary embodiment of the present invention.

FIG. 11 is a block diagram illustrating a display controller and a display driver included in an electronic device according to an exemplary embodiment of the present invention, and FIG. 12 is a flowchart illustrating a method of compensating for a degradation in an electronic device according to an exemplary embodiment of the present invention.

Referring to FIG. 11, a display controller 600 that controls an OLED display device may include an accumulation block 610 and a nonvolatile memory 620. A display driver 660 included in the OLED display device may include a data input block 670, a stress input block 675, a compensation factor calculation block 680 and a compensation block 490. The display controller 600 of FIG. 11 may not transfer a compensation factor but it may transfer stress data SD to the display driver 660.

Referring to FIGS. 11 and 12, the display controller 600 may receive image data RGB from an image source 605. The accumulation block 610 of the display controller 600 may calculate the stress data SD for the OLED display device by accumulating the image data RGB (S710). The nonvolatile memory 620 of the display controller 600 may store the stress data SD calculated by the accumulation block 610 (S720).

The display controller 600 may transfer the image data RGB and the stress data SD stored in the nonvolatile memory 620 to the display driver 660 of the OLED display device (S370). According to an exemplary embodiment of the present invention, the display controller 600 may transfer the stress data SD when the OLED display device is powered on, when a mode of the OLED display device is changed from a standby mode to a normal operation mode, continuously, or at predetermined time periods.

The stress input block 675 of the display driver 660 may receive the stress data SD from the display controller 600, and the compensation factor calculation block 680 of the display driver 660 may calculate red, green and blue compensation factors RCF, GCF and BCF for red, green and blue sub-pixels R, G and B based on the stress data SD (S740). The data input block 670 of the display driver 660 may receive the image data RGB from the display controller 600, and the compensation block 690 of the display driver 660 may perform a compensation operation on the image data RGB based on the red, green and blue compensation factors RCF, GCF and BCF to generate compensated image data CRGB (S750). The display driver 660 may drive a display panel to display an image based on the compensated image data CRGB (S760).

Accordingly, in a method of compensating for a degradation in an electronic device, according to an exemplary embodiment of the present invention, the display controller 600, having a high operational throughput and a large storage space, may perform the calculation and the storage of the stress data SD for the degradation compensation of the OLED display device. Thus, the display driver 660 of the OLED display device may have a small size, and the degradation compensation of the OLED display device may be efficiently performed.

Figure 13:
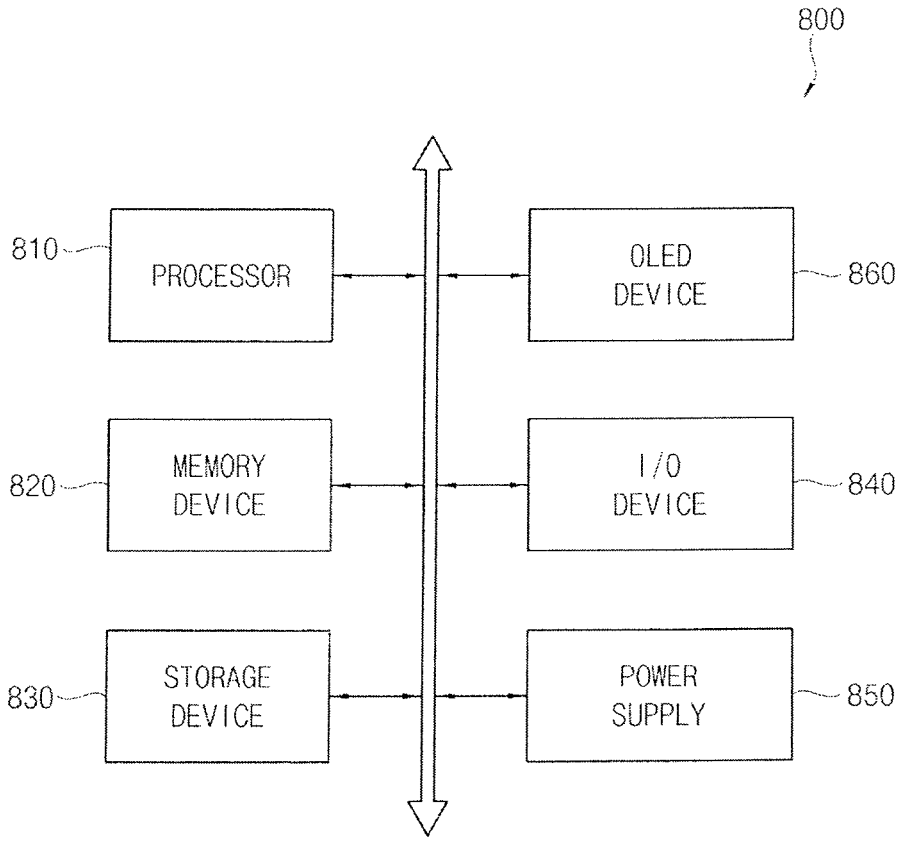
FIG. 13 is a block diagram illustrating an electronic device according to an exemplary embodiment of the present invention.

FIG. 13 is a block diagram illustrating an electronic device according to an exemplary embodiment of the present invention.

Referring to FIG. 13, an electronic device 800 may include a processor 810, a memory device 820, a storage device 830, an input/output (I/O) device 840, a power supply 850, and an OLED display device 860. The electronic device 800 may further include a plurality of ports for communicating a video card, a sound card, a memory card, a universal serial bus (USB) device, other electronic devices, etc.

The processor 810 may perform various computing functions. The processor 810 may be an AP, a micro processor, a CPU, etc. The processor 810 may be coupled to other components of the electronic device 800 via an address bus, a control bus, a data bus, etc. Further, in an exemplary embodiment of the present invention, the processor 810 may be further coupled to an extended bus such as a peripheral component interconnection (PCI) bus. The processor 810 may include a display controller (e.g., a GPU) that controls the OLED display device 860. The display controller of the processor 810 may perform the calculation and storage of stress data for the degradation compensation of the OLED display device 860.

The memory device 820 may store data for operations of the electronic device 800. For example, the memory device 820 may include a non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, or the like. In addition, the memory device 820 may include a volatile memory device such as a dynamic random access memory (DRAM) device, a static random access memory (SRAM) device, a mobile dynamic random access memory (mobile DRAM) device, or the like.

The storage device 830 may be a solid state drive device, a hard disk drive device, a compact disc, read-only memory (CD-ROM) device, etc. The I/O device 840 may include an input device such as a keyboard, a keypad, a mouse, a touch screen, etc, and an output device such as a printer, a speaker, etc. The power supply 850 may supply power for operations of the electronic device 800.

The OLED display device 860 may receive a compensation factor as well as image data from the processor 810 (or the display controller of the processor 810). The OLED display device 860 may convert the image data based on the compensation factor into compensated image data, and may display an image based on the compensated image data. Accordingly, since the processor 810 (or the display controller of the processor 810), having a high operational throughput and a large storage space, performs the calculation and the storage of the stress data for the degradation compensation of the OLED display device 860, a display driver of the OLED display device 860 may have a small size. Accordingly, the degradation compensation of the OLED display device 860 may be efficiently performed.

The electronic device 800 may be any electronic device that includes the OLED display device 860, for example, a cellular phone, a smart phone, a tablet computer, a wearable device, a PDA, a PMP, a digital camera, a music player, a portable game console, a navigation system, a digital television, a 3D television, a PC, a home appliance, a laptop computer, etc.

While the present invention has been particularly shown and described with reference to exemplary embodiments thereof, it will be apparent to those of ordinary skill in the art that various changes in form and detail may be made therein without departing from the spirit and scope of the present invention as defined by the following claims.

What is claimed is:

1. An electronic device, comprising: an organic light emitting diode (OLED) display device; and a display controller configured to provide image data to the OLED display device, wherein the display controller calculates stress data for the OLED display device by accumulating the image data, and determines a compensation factor for the OLED display device based on the stress data, and wherein the OLED display device receives the image data and the compensation factor from the display controller, converts the image data into compensated image data based on the compensation factor, and displays an image based on the compensated image data; wherein the OLED display device includes a first pixel, the first pixel including a red sub-pixel, a preen sub-pixel and a blue sub-pixel, and wherein the display controller determines, as the compensation factor, a common compensation factor for the red, green and blue sub-pixels, a red additional compensation factor for the red sub-pixel, a preen additional compensation factor for the green sub-pixel, and a blue additional compensation factor for the blue sub-pixel; wherein the display controller includes: an accumulation block configured to calculate the stress data for the OLED display device by accumulating the image data; a nonvolatile memory configured to store the stress data; a compensation factor calculation block configured to calculate a red compensation factor for the red sub-pixel, a green compensation factor for the green sub-pixel and a blue compensation factor for the blue sub-pixel based on the stress data; a common factor calculation block configured to calculate the common compensation factor, the red additional compensation factor, the green additional compensation factor and the blue additional compensation factor based on the red compensation factor, the green compensation factor and the blue compensation factor; and a first compensation block configured to perform a first compensation operation on the image data based on the common compensation factor.

2. The electronic device of claim 1, wherein the display controller performs a first compensation operation on the image data based on the common compensation factor, and wherein the OLED display device receives the image data, on which the first compensation operation is performed, and the red, green and blue additional compensation factors from the display controller, and the OLED display device generates the compensated image data by performing a second compensation operation on the image data, on which the first compensation operation is performed, based on the red, green and blue additional compensation factors.

3. The electronic device of claim 2, wherein the first compensation operation includes selecting a smallest degradation degree, among a degradation degree of the red sub-pixel, a degradation degree of the green sub-pixel and a degradation degree of the blue sub-pixel, and compensating for the degradation of the red, green and blue sub-pixels based on the selected degradation degree, and wherein the second compensation operation includes compensating for the degradation of the sub-pixels other than the sub-pixel selected to have the smallest degradation degree, from among the red, green and blue sub-pixels.

4. The electronic device of claim 1, wherein the common factor calculation block is configured to: determine the common compensation factor as a lowest one of the red compensation factor, the green compensation factor and the blue compensation factor, determine the red additional compensation factor as a ratio of the red compensation factor to the common compensation factor, determine the green additional compensation factor as a ratio of the green compensation factor to the common compensation factor, and determine the blue additional compensation factor as a ratio of the blue compensation factor to the common compensation factor.

5. The electronic device of claim 1, wherein the OLED display device includes: a data input block configured to receive the image data on which the first compensation operation is performed from the display controller; an additional factor input block configured to receive the red, green and blue additional compensation factors from the display controller; and a second compensation block configured to perform a second compensation operation on the image data, on which the first compensation operation is performed, based on the red, green and blue additional compensation factors.

6. The electronic device of claim 1, wherein the display controller is a graphic processing unit (GPU) included in a processor, wherein the processor controls an operation of the electronic device.

7. A method of compensating for degradation in an electronic device, the electronic device including an organic light emitting diode (OLED) display device, and a display controller configured to provide image data to the OLED display device, wherein the OLED display device includes a red sub-pixel, a green sub-pixel and a blue sub-pixel, the method comprising: calculating, by the display controller, stress data for the OLED display device by accumulating the image data; storing the stress data in the display controller; calculating, by the display controller, a common compensation factor for the red, the green and the blue sub-pixels, and calculating an additional compensation factor for the red sub-pixel, an additional compensation factor for the green sub-pixel and an additional compensation factor for the blue sub-pixel; performing, by the display controller, a first compensation operation on the image data in response to the common compensation factor; transferring, by the display controller, the image data on which the first compensation operation is performed and the red, green and blue additional compensation factors to the OLED display device; performing, by the OLED display device, a second compensation operation on the image data on which the first compensation operation is performed in response to the red, green and blue additional compensation factors to generate compensated image data; and displaying, by the OLED display device, an image in response to the compensated image data; wherein calculating the common compensation factor and the red, preen and blue additional compensation factors includes: calculating a red compensation factor for the red sub-pixel, a preen compensation factor for the green sub-pixel and a blue compensation factor for the blue sub-pixel in response to the stress data; and calculating the common compensation factor, the red additional compensation factor, the preen additional compensation factor and the blue additional compensation factor in response to the red compensation factor, the green compensation factor and the blue compensation factor.

8. The method of claim 7, wherein the first compensation operation includes selecting a smallest degradation degree, among a degradation degree of the red sub-pixel, a degradation degree of the green sub-pixel and a degradation degree of the blue sub-pixel, and compensating for the degradation of the red, green and blue sub-pixels in response to the selected degradation degree, and wherein the second compensation operation includes compensating for the degradation of the sub-pixels other than the sub-pixel selected to have the smallest degradation degree, from among the red, green and blue sub-pixels.

9. The method of claim 7, wherein the common compensation factor is the smallest of the red compensation factor, the green compensation factor and the blue compensation factor, the red additional compensation factor is a ratio of the red compensation factor to the common compensation factor, the green additional compensation factor is a ratio of the green compensation factor to the common compensation factor, and the blue additional compensation factor is a ratio of the blue compensation factor to the common compensation factor.

10. The method of claim 7, wherein the stress data is stored in a nonvolatile memory included in a processor, wherein the processor controls an operation of the electronic device.

* * * * *